US005092327A

United States Patent [19]

Tragatschnig

[11] Patent Number: 5,092,327

[45] Date of Patent: Mar. 3, 1992

[54] DIVING EQUIPMENT POWERED BY A DIVER'S EXERTION

[76] Inventor: Joerg Tragatschnig, Erlhofweg 2/2A, A-5700 Zell am See, Austria

[21] Appl. No.: 629,064

[22] Filed: Dec. 14, 1990

Related U.S. Application Data

[63] Continuation of Ser. No. 327,065, filed as PCT/EP88/00552, Jun. 22, 1988, abandoned.

[30] Foreign Application Priority Data

Jun. 29, 1987 [DE] Fed. Rep. of Germany ..... 3721429

[51] Int. Cl.[5] ..... A62B 7/00; A62B 9/00

[52] U.S. Cl. ..... 128/205.13; 128/205.16; 128/205.14; 128/205.18; 128/205.22; 128/201.27

[58] Field of Search ..... 128/200.24, 201.11, 128/201.27, 205.18, 205.13, 205.14, 205.15, 205.16, 205.22

[56] References Cited

U.S. PATENT DOCUMENTS

| | | | |
|---|---|---|---|
| 760,880 | 5/1904 | Lawson | 128/201.27 |
| 1,477,627 | 12/1923 | Campbell | 128/201.27 |
| 3,050,055 | 8/1962 | Vautin | 128/205.18 |
| 3,749,524 | 7/1973 | Jordan | 128/205.18 |
| 4,245,632 | 1/1981 | Houston | 128/205.13 |

FOREIGN PATENT DOCUMENTS

| | | | |
|---|---|---|---|
| 212610 | 2/1958 | Australia | 128/201.11 |
| 1492289 | 7/1967 | France | 128/201.11 |
| 464857 | 7/1951 | Italy | 128/201.11 |

*Primary Examiner*—Edgar S. Burr
*Assistant Examiner*—Kimberly L. Asher
*Attorney, Agent, or Firm*—Krass & Young

[57] ABSTRACT

A muscle-powered diving equipment comprising a pump worn by the diver, which is operated by the diver's legs by means of a belt arrangement and foot loops attached thereto. When the diver's legs are extended, air is sucked in through a tube whose end is attached to a floating buoy. When the diver's legs are bent, the aspirated air is compressed by the pressure of the surrounding water and can be breathed in by the diver through a breathing tube. The exhaled air escapes through an expiration valve into the water.

23 Claims, 13 Drawing Sheets

18

16
14
76
Detail A
84

30
76
79
80
82

Fig. 14
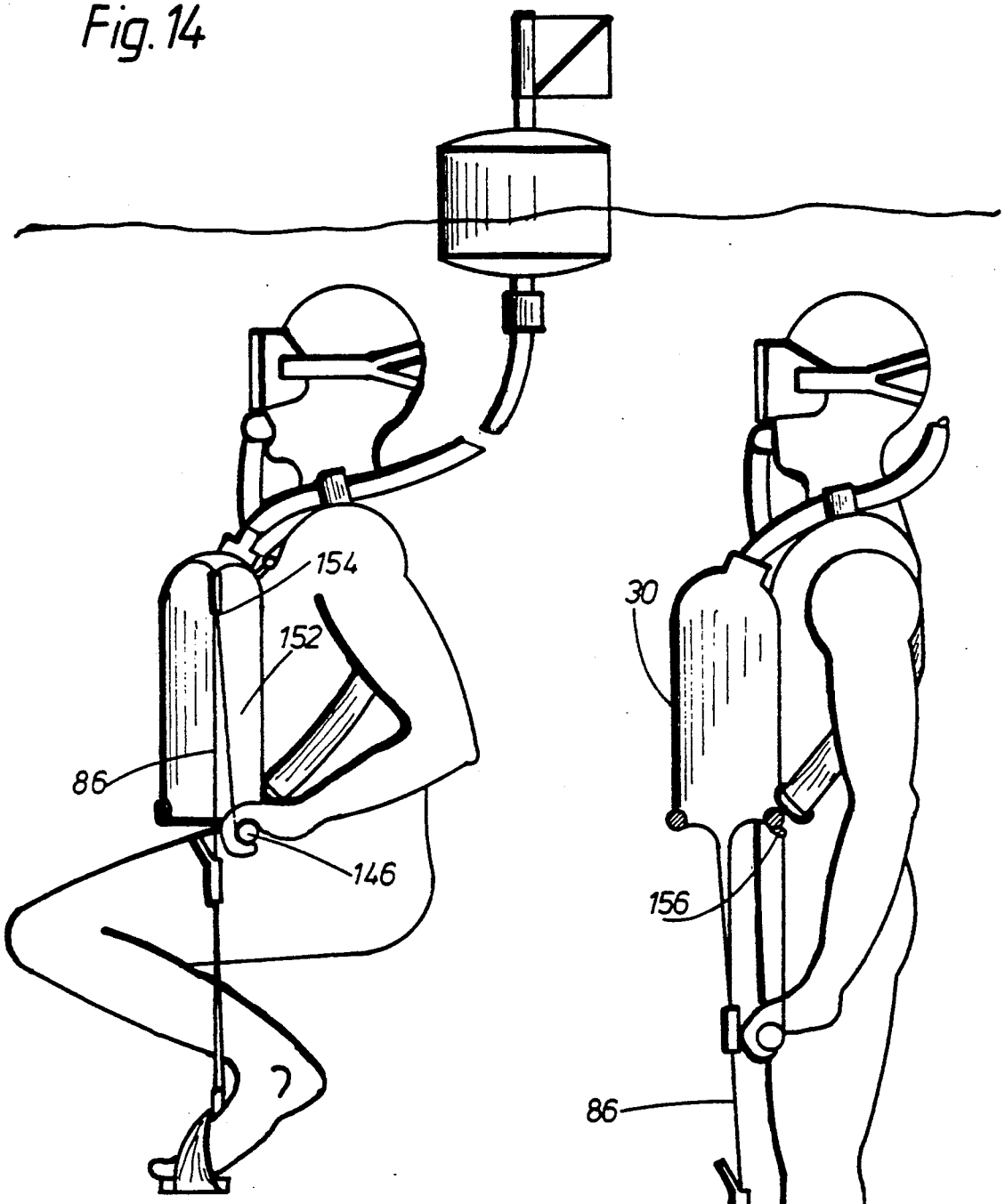
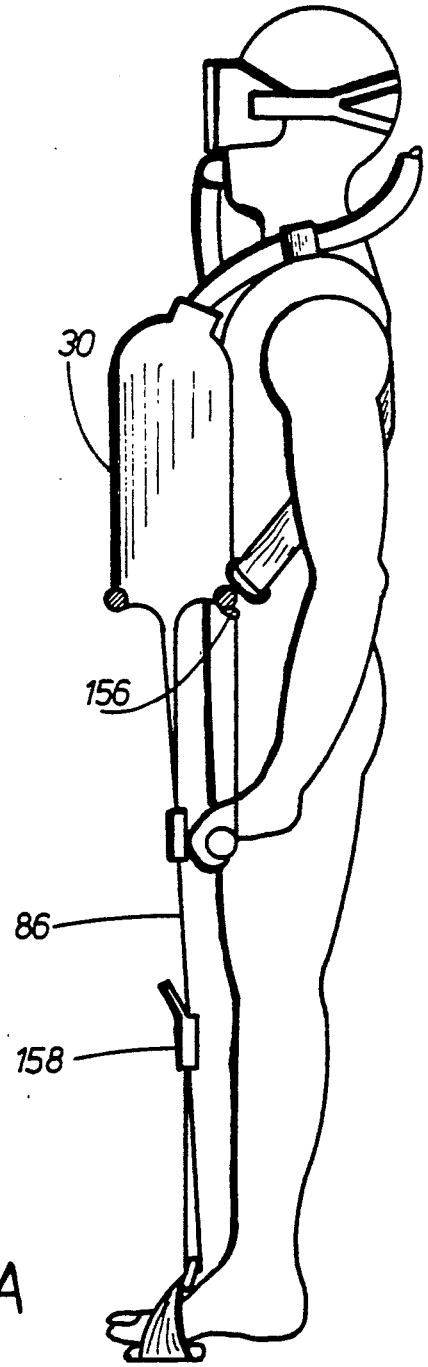
Fig. 14A

DIVING EQUIPMENT POWERED BY A DIVER'S EXERTION

This is a continuation of co-pending application Ser. No. 327,965 filed as PCT/EP88/00552, Jun. 22, 1988, now abandoned.

This invention relates to diving equipment with an air supply line which, on the one hand, is connected to the atmosphere above the water surface and, on the other hand, leads to the mouth of the user of the apparatus.

Equipment of this type is commonly known as snorkel. The advantages of snorkeling are: simplicity, the reasonable price and the light weight of the gear, as well as the relatively low risk of snorkeling. However, the disadvantage of snorkeling is especially the short diving time of approximately one minute by holding one's breath.

A considerably more expensive alternative to snorkeling is scuba diving, which is significantly more demanding. The advantage of scuba diving over snorkeling is the possibility of diving freely and independently to depths in excess of 50 meters. However, the disadvantage of scuba diving is the limited diving time of half an hour to two hours, depending on the depth and the diving equipment. From a mechanical aspect, scuba diving gear is relatively complex, heavy, and requires intensive care and maintenance. The high pressure of the cylinder of about 200 to 300 bar constitutes a constant danger. Therefore, the compressed air tanks must be checked at regular intervals for rust-through marks.

In general, scuba diving demands, aside from a thorough training of the diver, good organizing skills and auxiliary facilities because the diver constantly depends on compressors and/or filling stations. When diving to depths beyond 10 meters, the diver faces a series of physiological hazards, such as diver's paralysis, rapture of depths and oxygen poisoning. Therefore, when diving strictly as a sport, the 10-meter realm is particular significance not at least on account of the still good light that prevails at that depth in most cases.

The object of this invention, therefore, is to provide a diving gear of simple construction and flexible adaptation that can be easily transported and used in depths of up to 10 meters and which is not subject to a limited diving time.

This problem can basically be solved by an air pump which is activated by muscle pressure to supply air from the atmosphere to the mouth of the user of the apparatus via an air supply line and, furthermore, by providing an activating device connected to the air pump for the purpose of activating the air pump which can be fastened to one or more of the diver's limbs or which can be positioned within easy reach of the diver. Furthermore, the problem can be overcome by providing a sealable air outlet for exhaust bubbles by means of an exhaust valve. The air outlet, as seen from the direction of the air flow supplied by the air pump, is positioned in the back of the air pump.

In a preferred design of the invention, the air pump can be fastened to the body of the diver by means of shoulder straps or a similar device and can be activated by means of pulling devices such as belts, etc., which are attached in an appropriate manner to the diver's legs.

The invented equipment is, therefore, in principle a pump, activated by muscle power, by means of which the diver himself, combined with swimming strokes, channels air below the water surface via a hose and pressurizes this air, necessary for breathing.

The upper end of the hose leading upwards into the atmosphere is, according to a further preferred development of this invention, secured to a floating element, particularly such as an inflatable buoy, which is preferably constructed as a diving-signal buoy and which keeps the end of the hose above the water surface.

A preferred design of the air pump comprises a rigid exterior body, the enclosed upper side of which is connected to the air supply lines leading to the water surface on the one hand and to the diver's mouth on the other hand. The open underside of the air pump is closed off by means of a flexible bellows- or bag-like part which, when subjected to external over-pressure and by reducing the pump volume, is being pressed into the interior of the exterior body and which is dimensioned in such a way that it can basically fill the inside of the exterior body completely, and thus the activating device engages the flexible part.

As an alternative, the air pump can be designed as bellows, which are sectionally rigid in form. The upper side of the bellows is connected to the air hoses, and the activating device engages into the underside of the pump.

Furthermore, the air pump can appropriately comprise also a cylinder and a piston housed in the cylinder, in which case the enclosed upper side of the cylinder is connected to the air hoses, and the underside of the cylinder is open and the activating device engages the piston.

When the diving gear is being submerged, i.e. in the case of the air pump design as mentioned initially, the bellows—at the end of which two belts are attached which are provided with two stirrups at the ends of the belt—are pressed into the rigid outer body by the water pressure and thus the air located there is being put under the respective ambient pressure. Air can be inhaled by means of the intake hose which feeds into the closed end of the rigid exterior body. A valve, positioned at the mouth of the exhaust hose, prevents the backflow of air at the water surface. The inhaled air is returned again to the intake hose and another valve prevents the exhaled air from flowing back into the pump volume. The exhaust bubbles finally discharge into the water by way of the exhaust valve.

While the air is being desiccated, fresh air is sucked into the pump volume via the hose which leads to the water surface and by extending the bellows from the container-like, rigid exterior body. When the bellows are released, the air is once again being compressed and can thus be inhaled.

The air pump is preferably to be carried in front of the chest with the advantage that when the diver assumes an upright, horizontal or a slightly head-inclined swimming position, the pump volume will be positioned lower than the lungs, thus creating in the pump volume, as compared to the lung volume, a slight over-pressure which especially in physical exertion permits comfortable breathing.

Since the air pump is activated by stretching the legs while exhaling, thus filling the pump volume with fresh air, and by pulling the legs up while inhaling, thus making it possible to inhale the fresh air contained in the pump volume, the respiratory movement cycle of the diving apparatus of the invention corresponds to that of the breast stroke swimmer. The movement rhythm of the legs on which the activating of the diving equipment depends, can therefore be easily learned especially by breast stroke swimmers.

The diving gear of the invention is normally donned on land. After slipping into the stirrups, the diver can move freely without any encumbrances that are worth mentioning. He can walk normally and jump or rather enter the water feet first.

If the ballast is tared correctly, it is possible to effect and/or support the diver's descent and ascent by carefully synchronizing the pump- and breathing activities, because the uplift of the diving gear depends on the quantity of air in the pump volume. If the diver does not stretch his legs completely, so that the pump volume does not completely fill up with air, the diver will descend. If, however, the diver's legs are stretched fully and thereby filling the pump volume completely with fresh air, the uplift of the air pump increases and the diver ascends.

Since the maximum volume of the pump has been adjusted to a maximum diving depth of approximately 10 meters, in such a way that the fresh air present in the pump volume is fully consumed in one breathing cycle, so that the pump volume of the air pump is preferably about 6 liters, the above-described method of influencing the diver's descent and ascent becomes less significant in greater diving depths due to the fact that in these greater depths the full lifting force of the air pump is required to adequately suck in air.

To avoid always having to stretch the legs only to a certain degree or to stretch them fully for taring purposes, a further development of the invention makes it possible to adjust, especially by means of quick-adjustment devices, the length of the foot straps to which the stirrups are attached. Depending on whether the diver wishes to remain at the same diving depth or if he wants to ascend or descend, he will thus be able to adjust the length of the straps individually which will make it possible for him to stretch his legs fully in each activating cycle. In this position of stretched legs it is not necessary, depending on the adjustment of the belt, for the bellows, or more generally speaking the movable element of the pump, to be fully extended, and thus the maximum pump volume can be controlled contingent on the length of the straps.

A preferred further development of the invention makes it possible for the outlet side of the air pump to be connected to an auxiliary flexible air supply container by means of a non-return valve. Contact between this air supply container and the diver's mouth is established via a hose. This air supply container can be preferably fastened to the diver's body, for example by means of belts or similar devices. Due to its buffer effect, such an air supply container makes the interdependence between the diver's legs and his breathing obsolete and thereby further simplifying the use of the diving gear of the invention. Such an auxiliary air supply container can prove to be of advantage especially in moderate diving depths where the additional uplift of the air supply container is not yet felt very strongly.

In the above description it was assumed that the air pump can be activated by the diver's leg movements. As an alternative, it is also possible for the air pump to be activated by the diver's arms. For this purpose, the belt or rope connected to the flexible part of the air pump has at the end of the former been provided with a suitable hand-grip. In its simplest design, this hand-grip can be constructed as a bar which the diver's hands can grab from both sides. If the gear is to be activated by foot the diver's hands are free either for swimming strokes or for gathering purposes, or taking photograph, or the like. When the diving gear is activated by the arms, the diver's feet are free to don the customary fins.

An alternative design of this invention makes it possible that the device for activating the air pump be equipped with at least one stirrup or a similar device and, in addition, with at least one hand-grip. The air pump can then be activated either by the diver's hand or by his leg movements, as desired. Furthermore, especially in greater depths, the leg movement can be supported by an additional, synchronized arm movement, if required.

Whereas it was assumed in the foregoing that the air pump is secured to the diver's body, an alternative design of the invention provides that the air pump be secured to a floating element such as for example a diving buoy, in which case the contact between the air pump and the diver's mouth is established via a hose and particularly by interconnecting an auxiliary air supply container.

In this case the air pump is preferably constructed as a cylindrical body which is enclosed on all sides and in which a piston is flexibly housed in an axial direction, thus dividing the cylindrical body into an upper and a lower chamber volume. The upper chamber volume is connected to the air hose leading to the atmosphere by means of a non-return valve. The lower chamber volume is connected to the air hose which leads to the diver's mouth by means of a non-return valve. The piston has an opening which is closed off by means of a non-returnable valve and which connects the upper to the lower chamber volume. Furthermore, a spring is provided which tensions the piston in the direction of the upper chamber volume, and the activating device engages the piston and counteracts the force of the spring. In this case, the activating device can appropriately be a Bowden wire.

As can be seen from the preceding explanations, the diving gear of the invention is very compact and fits e.g. into a medium-size sports bag. The exterior, rigid and container-like body of the pump can be used, if the bellows are tucked in, as a container for accessories, such as masks, camera, knife, etc.

Aside from its use strictly as a sports and hobby diving gear, the invented equipment can also be used as boat or yacht accessory, e.g. for cleaning or repairing underwater parts of submarines (e.g. to replace screw propellers) or for locating lost items in a shallow harbour basin. Possible realms of application are to be found where underwater activities in relatively shallow waters become necessary from time to time and where the acquisition and maintenance of scuba-diving gear would not be worthwhile. Furthermore, the invented diving gear could be of interest to scuba divers as auxiliary equipment in order to save compressed air under certain conditions.

Owing to its simplicity of construction, the invented diving gear can be produced very economically and can therefore be offered for sale at a fraction of the cost of the customary, basic scuba-diving gear.

In summary, therefore, it can be established that the invented equipment concerns a diving gear of very simple construction and dependable operation which can be used in depths of up to about 10 meters. The invented gear is not dependent on filling stations and diving bases and is very adaptable in application. Furthermore, the diving gear is not subject to a limited diving time. Due to its compact size and light weight, it can be transported over considerable distances by foot, bicycle, etc. From a technical aspect, the diving equipment is not demanding. It requires hardly any care or maintenance and, in consideration of its realms of application, it is very reasonably priced.

Further advantageous features of the invention will become obvious from the subclaims, as well as from the following description in which several preferred designs of the invention are explained in detail on the basis of the drawings.

The semi-schematic drawing shows in

FIG. 1 a front and FIG. 1A is a side view of a first embodiment of the diving equipment in operation.

FIGS. 14 and 14A show two side views of the diving equipment as shown in FIG. 11 in a position where the diver's legs are bent and stretched respectively.

In the description below, the same terms of reference denote the same or corresponding parts of the various forms of construction.

Figures 1, 1A:
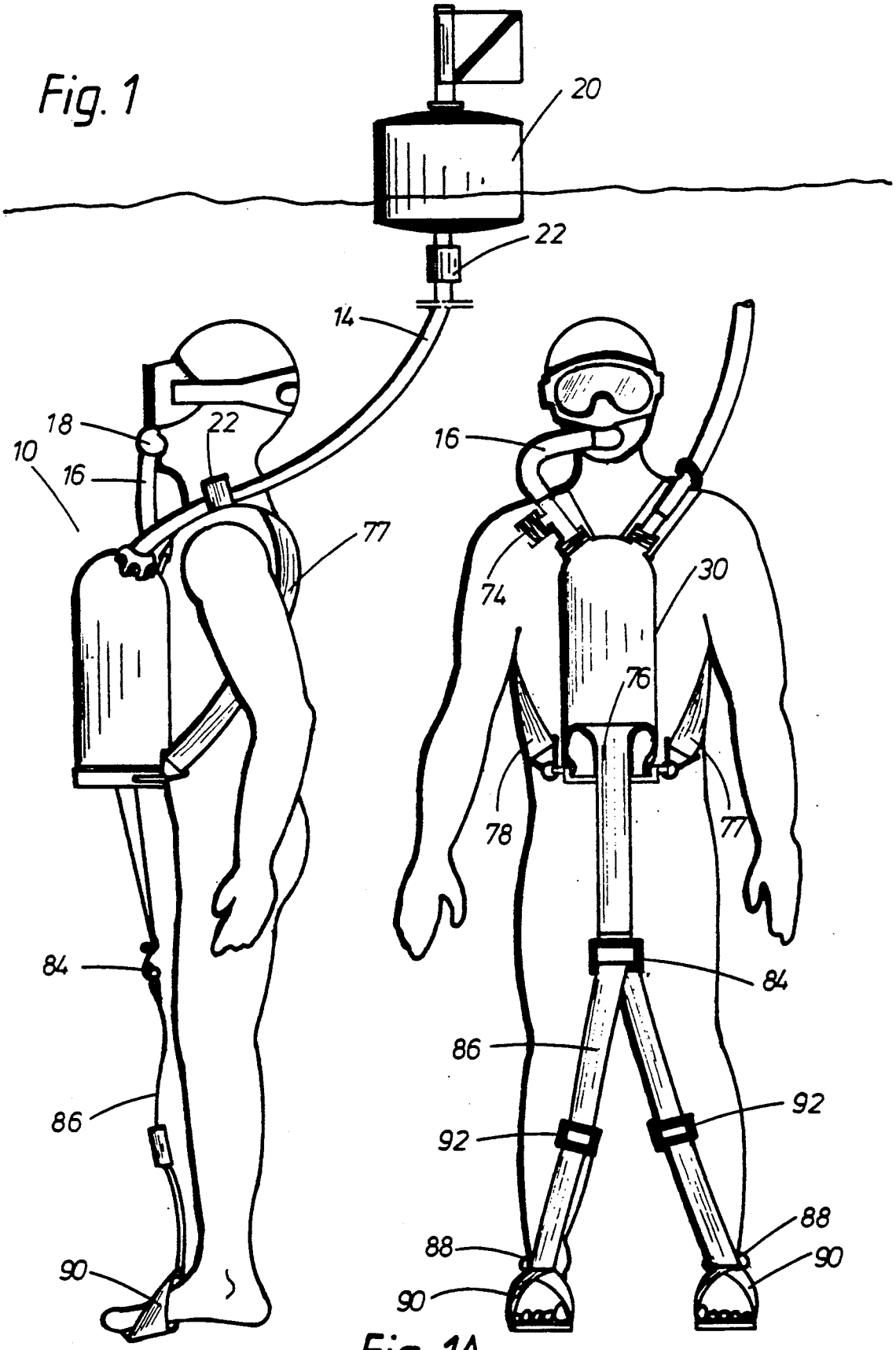
Figure 2:
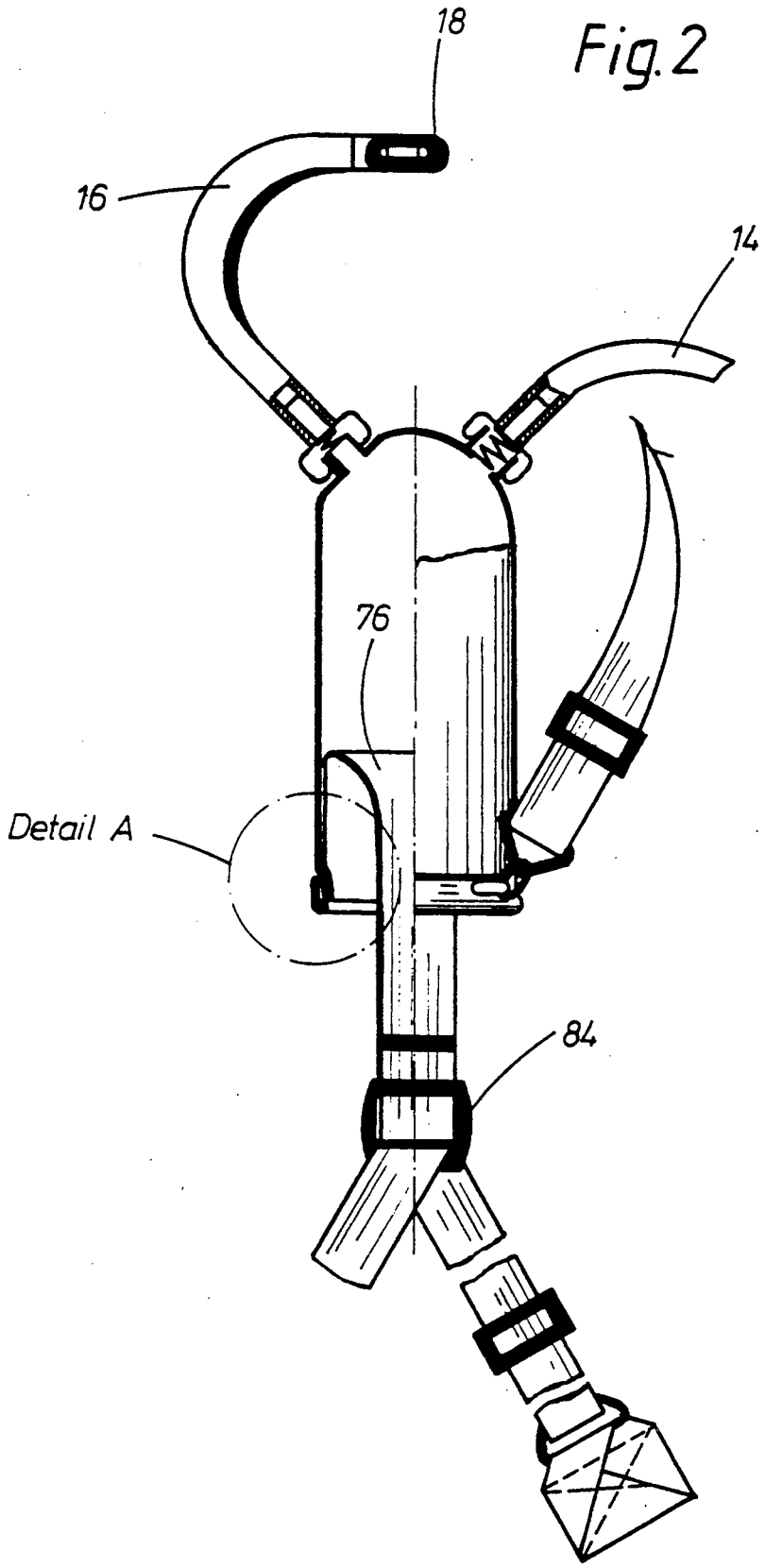
FIG. 2 is a fragmentary side view of the diving equipment shown in FIG. 1.
Figure 3:
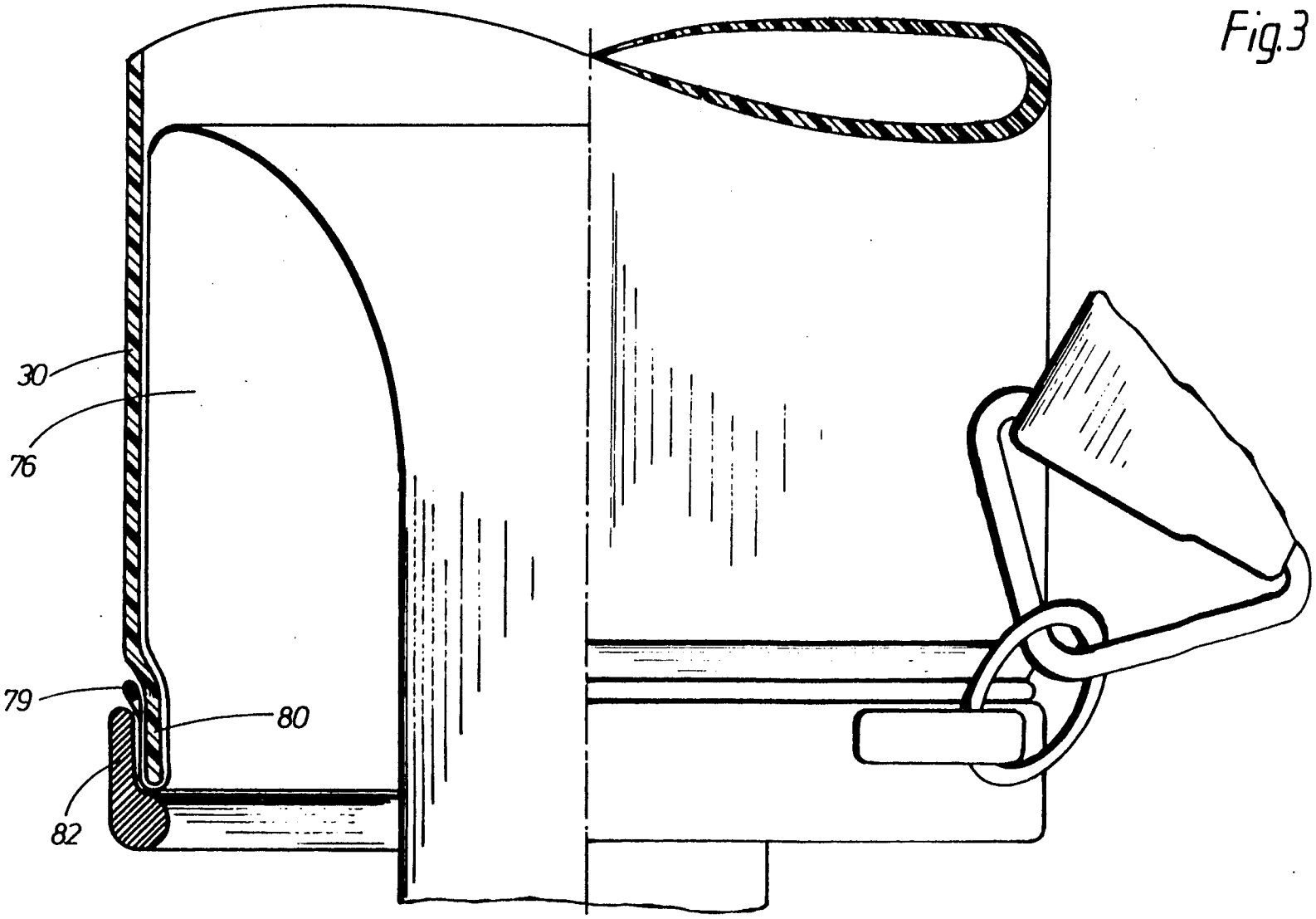
FIG. 3 shows detail A, according to FIG. 2.

Reference is made first of all to the form of construction shown in FIGS. 1 to 4.

The diving equipment comprises a pump (10), an activating device (12) of the pump (10), as well as flexible hoses (14 and 16). On the one hand, the flexible pressure hose (14) is connected to the pump (10) and on the other hand to the atmosphere above the water surface. The upper end of the hose (14) is secured by an inflatable buoy (20), which is especially constructed as a diving-signal buoy in order to alert approaching boats and to mark the diving spot. In emergencies, the buoy (20) can be used as a kind of life buoy, in which case the buoy (20) can be equipped, if necessary, with loops or similar devices, which are not detailed on the drawing. Furthermore, the buoy (20) can be provided with additional fastening devices to hang up the pump (10) if not in use, or when changing divers, so that the diver does not have to climb into the boat with his complete gear. In addition, the diving gear is floatable, if the bellows are extended and locked into position.

The length of the hose (14) limits the maximum diving depth. Markings provided on the hose can serve as simple depth gauge. The hose (14) can also be used as signal line and "buddy line" (coupling the buoys of two divers in order not to lose contact with each other when visibility is obscured) or for control purposes (respiratory sounds are audible at the surface).

The hose (16) leads from the pump (10) to a mouthpiece (18) which the diver holds in his mouth when using the diving equipment.

Furthermore, detachable hose connections (22, 24) are provided near the buoy (20) and near the pump (10) to replace the interjacent piece of hose in adaptation to the respectively required hose length. At the buoy (20) and/or the hose, additional weights have been provided to stabilize the buoy in an upright position.

Figure 4:
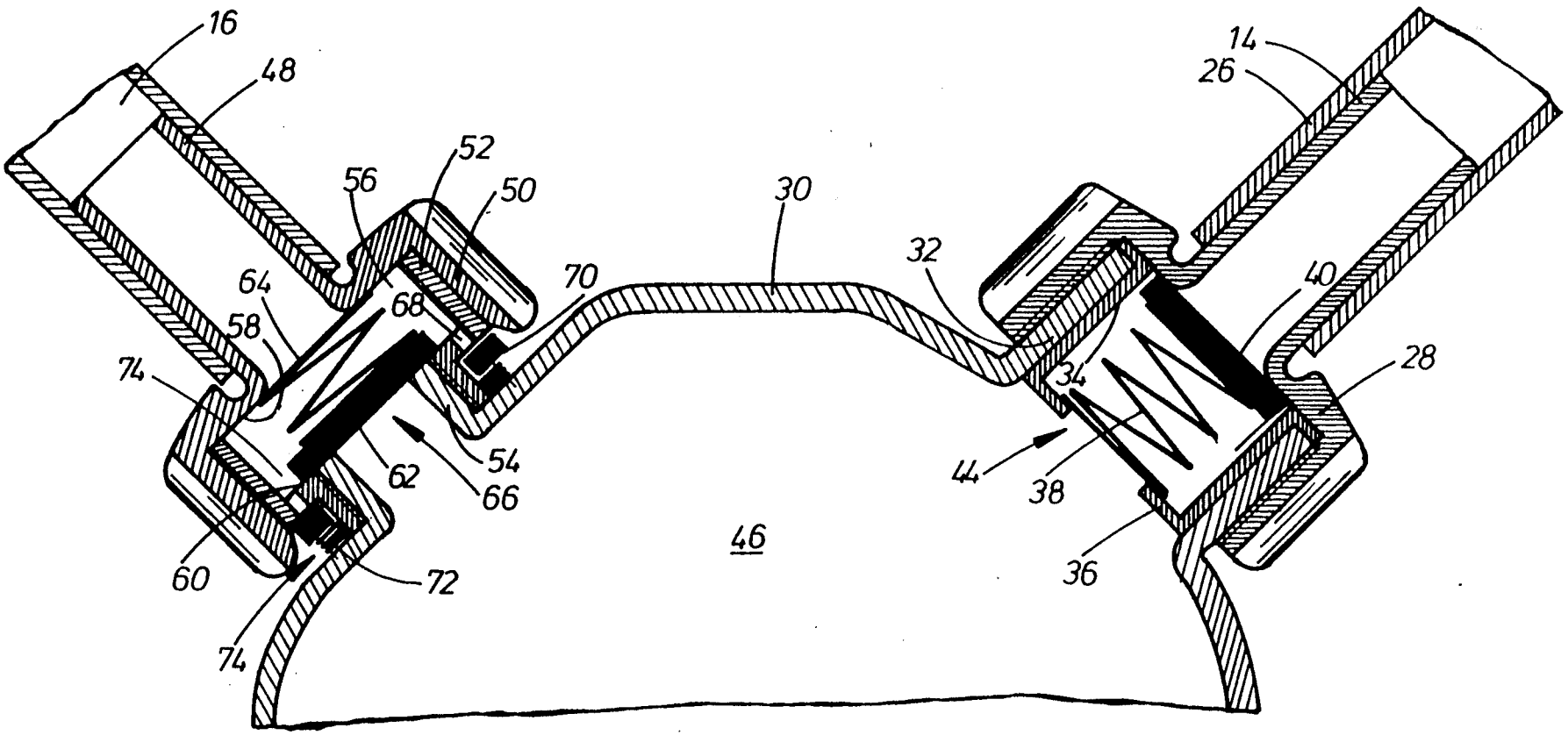
FIG. 4 shows the upper realm of the pump of the diving equipment, as illustrated in FIG. 2.

As can be clearly seen, particularly from FIG. 4, the end of the hose (14) which is close to the pump is slid over a connecting piece (26) which is situated on a screw-on ring (28) which in turn is screwed onto an outwardly projecting threaded ferrule (32) situated on the top side of the pump casing (30). Located between the outer edge of the threaded ferrule (32) and the screw-on ring (28) is a cylindrical supporting element (34), which on its inner side facing the pump has a torus* (36) which projects inwardly and supports a compression spring (38). The other end of the compression spring (38), is connected to a disk-shaped sealing element (40) which, on account of the force exerted by the compression spring (38) is pressed against an annular sealing surface (42) at the inner end of the connecting piece (26). The non-return valve (44) formed by the above-described arrangement is generally closed but opens, however, as soon as the pressure in the hose (14) exceeds the existing pressure in the pump volume (46) of the pump (10) by a certain degree.

Translator's Note: *36 torus=also 'annular area

The end of the hose (16) which is located opposite to the mouthpiece (18) is slid over a connecting piece (48) which is situated on a screw-on ring (50). The screw-on ring (50) is screwed onto an intermediate piece (52) which itself is screwed onto another threaded ferrule (54), located on the top side of the pump casing (30) and which projects outwardly. The intermediate piece (52) together with the screw-on ring (50) form a cylindrical chamber (56) which has two toruses (58, 60) facing each other and running in a radial direction. A disk-like sealing element (62) rests against the torus (60) which faces the pump. This sealing element is tensioned into its sealing position by means of a compression spring (64). The compression spring (64) supports itself against the sealing element (62) and against the torus (58). The non-return valve (66) formed by the above-described arrangement is normally closed but opens as soon as the pressure in the pump volume (46) exceeds the pressure in the hose (16) by a certain degree.

The intermediate piece (52) defines at its exterior side an annular area which faces torus (60), and several through-bores (68) connect the chamber (56) to the outer ambience. A sealing ring (70) rests against this outer torus and thus seals the bore holes (68). By exerting a certain pressure, the sealing ring (70) is tensioned into its sealing position by means of a compression spring (72), positioned between the exterior surface of the sealing ring (70) and the wall of the pump casing (30), located opposite the latter. When the user of the equipment exhales, the sealing ring (70) lifts off from its seat, allowing the exhaust bubbles to escape into the water through the bore holes (68). The arrangement, as described above, thus constitutes an exhaust valve (74).

It ought to be mentioned that in the illustrated design shown in FIGS. 1 and 1A, the exhaust valve (74) is realized in a somewhat different way. In the latter case, a branching is provided in the hose (16) which can be sealed by means of an exhaust valve (74) constructed as a non-return valve.

Two shoulder belts (77, 78) are secured at the pump casing (30), which are designed in such a way that the pump (10) may be worn by the driver in front of his chest. If necessary, it is possible to use an additional waist belt, which is not detailed here.

The open rim of bag-like bellows (76) is secured to the bottom edge of the casing (30) of the pump (10). The bag-like bellows (76) can be made of an appropriate rubber material, e.g. reinforced by means of a fabric or of a rubberized fabric. The material must be airtight, waterproof, flexible and adequately strong. The size and dimensions of the bag-like bellows (76) basically correspond to the size of the pump casing (30). It can be clearly seen, particularly from FIG. 3 that the bag-like bellows (76) are secured to the bottom edge of the pump casing (30) in order that the bottom edge (79) can be folded over the lower rim (80) of the pump casing (30) facing outward. A clamping ring (82) is slid over the bottom edge (80) of the pump casing (30) from below in such a way that the bellows (76) are securely jammed between the clamping ring (82) and the casing of the pump (30).

A buckle (84), particularly adjustable in length to which a belt (86) is to be attached is fastened to the inner, upper end of the bag-like bellows (76). The ends of the belt (86) are formed into stirrups (90) by means of ties (88). These stirrups are adjustable in length by way of buckles (92). Normally, the length of the belt is adjusted in such a way that when the diver stands upright, the bag-like bellows (76) are almost extended completely from the pump casing (30). However, the belt is long enough that it can be adjusted in such a way that when the diver stands upright, the bellows (76) are only partially extended from the pump casing (30). A quick adjustment device of customary design, which is not detailed in the illustration, can be provided specially in the region above the buckle (84). This quick adjustment device will make a reliable adjustment in the length of the belt possible by a flick of the wrist.

Due to the water pressure, the bag-like bellows (76) are being almost completely pressed into the pump casing (30) during operation if the diver's legs are in a bent position. If the driver stretches his legs, the bellows (76) are being extended from the pump casing (30), thus creating an under-pressure in the pump volume (46) defined by the pump casing (30) and the bellows (76), with the result that by opening the non-return valve (44), fresh air is sucked into the pump volume via the hose (14). As soon as the diver subsequently bends his knees again, he is able to inhale the fresh air sucked in via the hose (16) and by means of opening the non-return valve (66), while at the same time reducing the pump volume. The exhaling takes place when the diver stretches his legs, in which case the exhaust bubbles escape into the water by means of the exhaust valve (74).

If water enters the intake hose, it can easily be removed by means of the exhaust valve 74. In the event that water enters the pump volume while diving, the diver pulls up his legs completely so that the bellows (76) come to rest against the inner wall of the pump casing (30), and the water which has penetrated is channeled into the intake hose (16) via the non-return valve (74) from where it can be removed in the above-described manner.

The pump casing can be made of any suitable material, however preferably of plastic. The necessary weights can be attached to a suitable spot of the pump casing. As an alternative, the weights can be substituted by rigid or flexible containers that can be fastened to both sides of the pump casing and which can be filled on the spot with suitable weights, such as stones, crushed stone, gravel, sand, etc.

Figure 5:
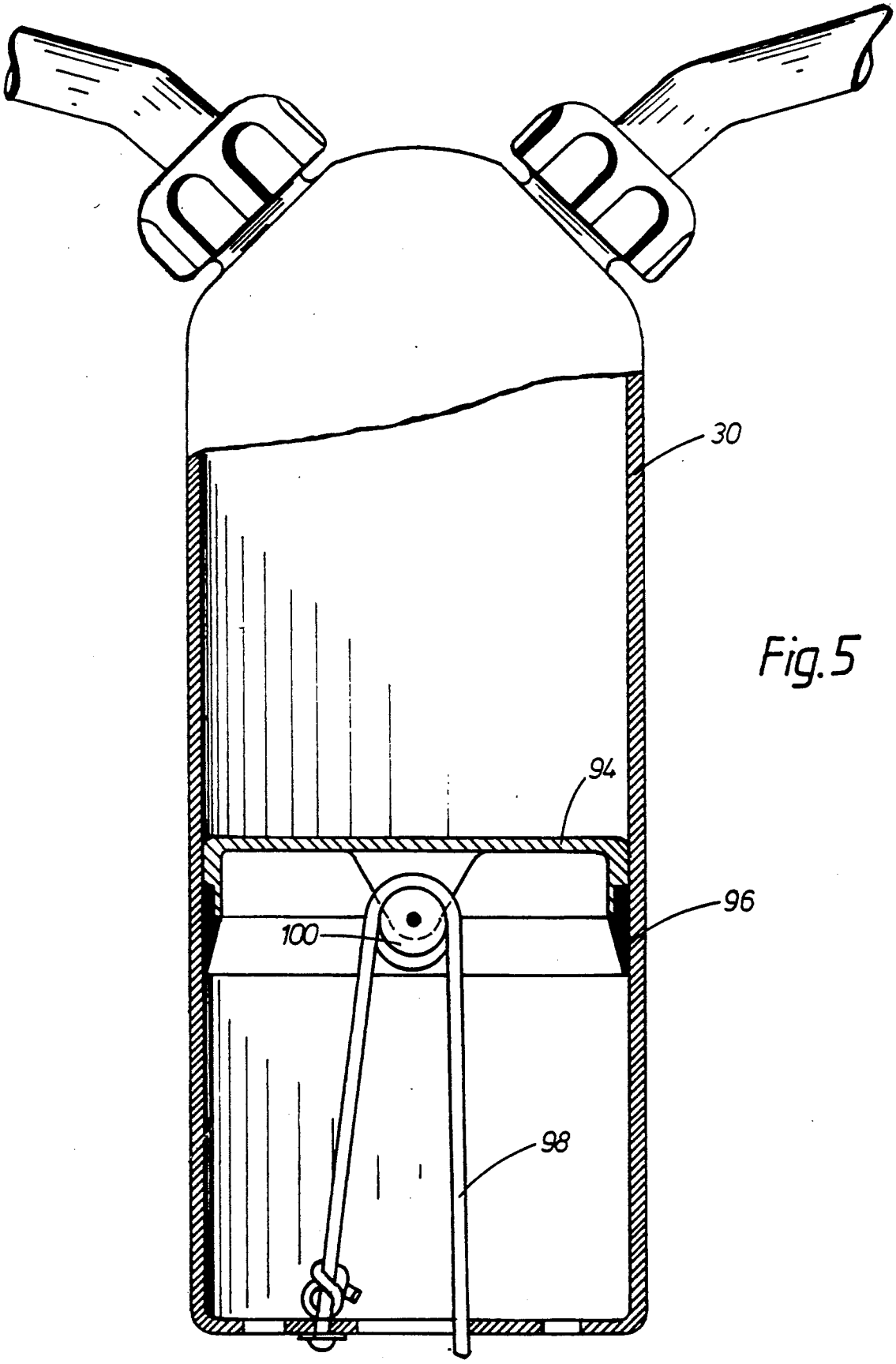
FIG. 5 is a sectional view of an alternative form of construction of a pump of an invented diving gear.

FIG. 5 shows an alternative design of the pump (10). Here a piston (94) is flexibly housed in an axial direction, e.g. with a gasket (96), in the rigid, cylindrical pump casing (30) which is enclosed on top and open at the bottom. This piston rests against the interior walls of the pump casing (30) and seals the latter. A pulling rope (98) connected to the foot straps or stirrups (90) is secured to the bottom of the pump casing (30) and is guided downward by means of a guide pulley (100), which is fastened to the centre of the bottom of the piston (94).

Figures 6, 6A:
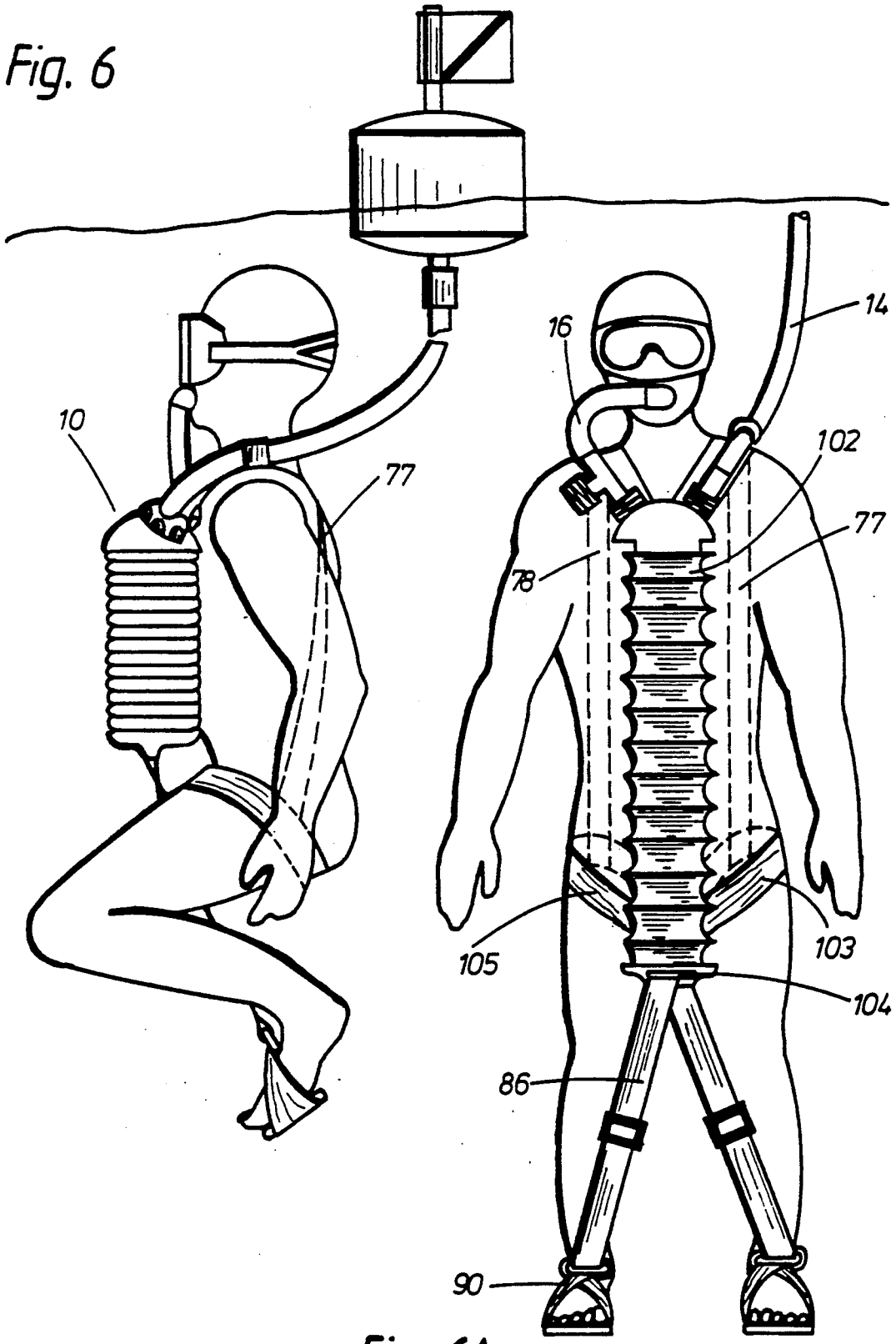
FIG. 6 is a side view and FIG. 6A is a front view of another design of the invented diving equipment in operation.

In the design illustrated in FIGS. 6 and 6A, the pump (10) consists of bellows (102), which are sectionally rigid in form, and which are enclosed on all sides. Provision is made at the upper end of the bellows for hoses (14 and 16) which correspond to those illustrated in FIG. 4. An opening (104) is provided at the bottom end of the bellows (102) into which the belt (86) and stirrups (90) engage.

Furthermore, in the design illustrated in FIGS. 6 and 6A, thigh straps (103, 105) are attached to the bottom ends of the shoulder belts (77, 78) and are consequently not secured to the pump (10).

Figures 7, 7A:
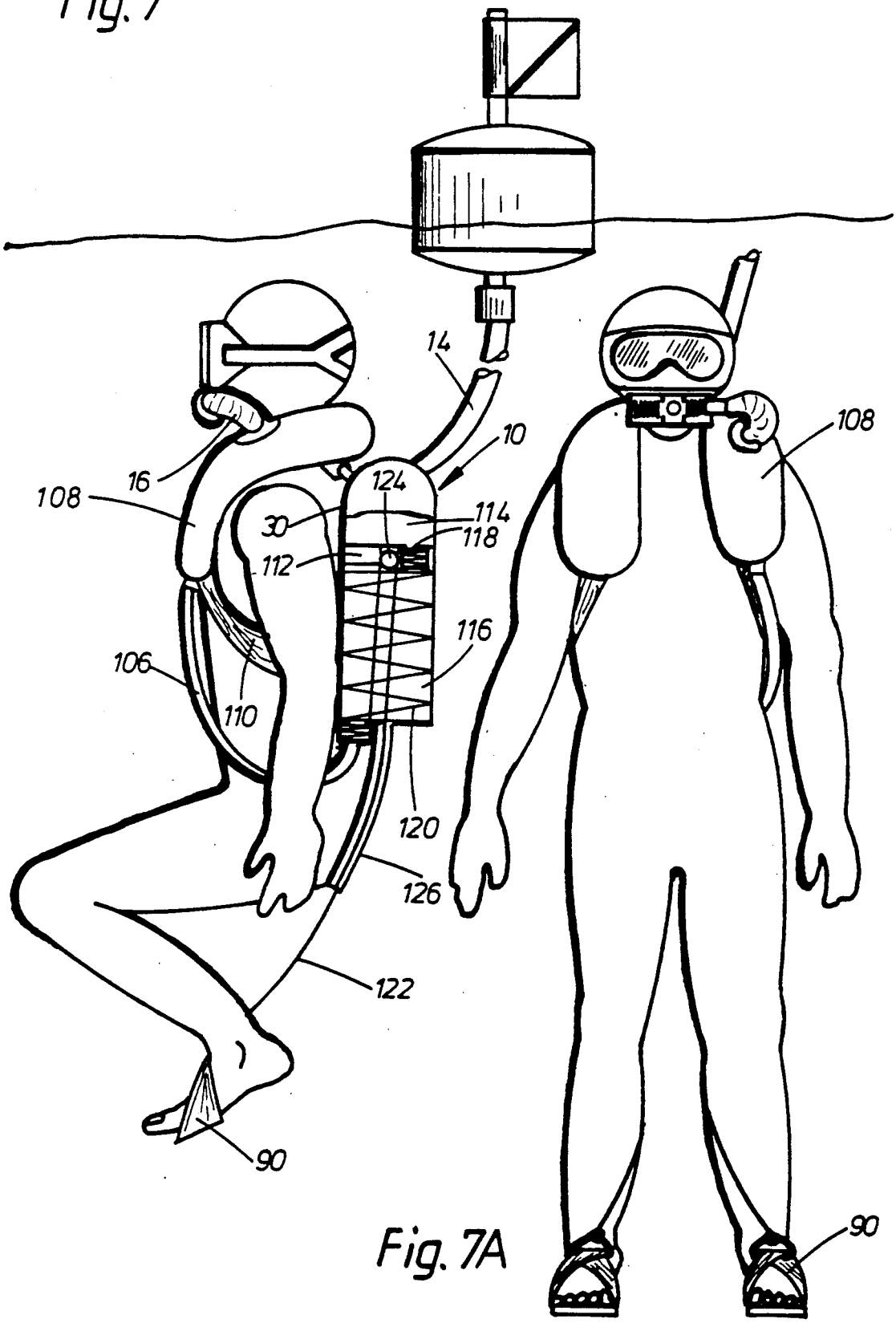
FIG. 7 is a side and FIG. 7A is a front view of another design of the invented diving equipment in operation.

In the form of construction illustrated in FIGS. 7 and 7A, the pump (10) comprises a cylindrical casing (30) which is enclosed on all sides and connected at its upper end to the hose (14) by means of a non-return valve, which is not illustrated on this drawing. At its bottom end, the casing is connected to a hose (106) by way of another non-return valve, and the hose ends in a hose-like air supply container (108). The intake hose (16) branches off from the hose-like air supply container (108) by means of a non-return valve. The air supply container (108) is placed around the shoulders and neck of the diver, and the two ends of a belt (110), led below the armpits and across the diver's back, are connected to the ends of the hose-like air supply container (108). In this design, the pump (10) is carried on the diver's back, in which case suitable shoulder belts are provided which can be connected to the belt (110).

Within the enclosed pump casing (30) a piston (102) movable in an axial direction is situated which divides the space enclosed by the pump casing (30) into an upper chamber (114) and a lower chamber (116). A non-return valve (118) is constructed in the piston (102) which opens as soon as the pressure in the upper chamber (114) exceeds the pressure in the lower chamber (116) by a certain degree. A compression spring (120) has been provided in the lower chamber (116) with the object of pushing the piston (112) upward. One end of a pulling rope (122) is fastened to the bottom edge of the lower chamber (116) and is led over a guiding pulley (124) which is positioned in the centre of the bottom of the piston (112). A flexible pipe connection (126) is secured to the bottom of the pump casing (30), which extends approximately below the diver's buttocks. The pulling rope (122) which extends from the guiding pulley (124) is guided in this short cylindrical piece (126) and a sealing device is provided in the short cylindrical piece (126), which is not detailed on the drawing, in order to seal off the cylindrical piece and thereby the lower chamber (116) from the outer surroundings. The end of the pulling rope (122) is connected to the two stirrups (90).

Figures 8, 8A:
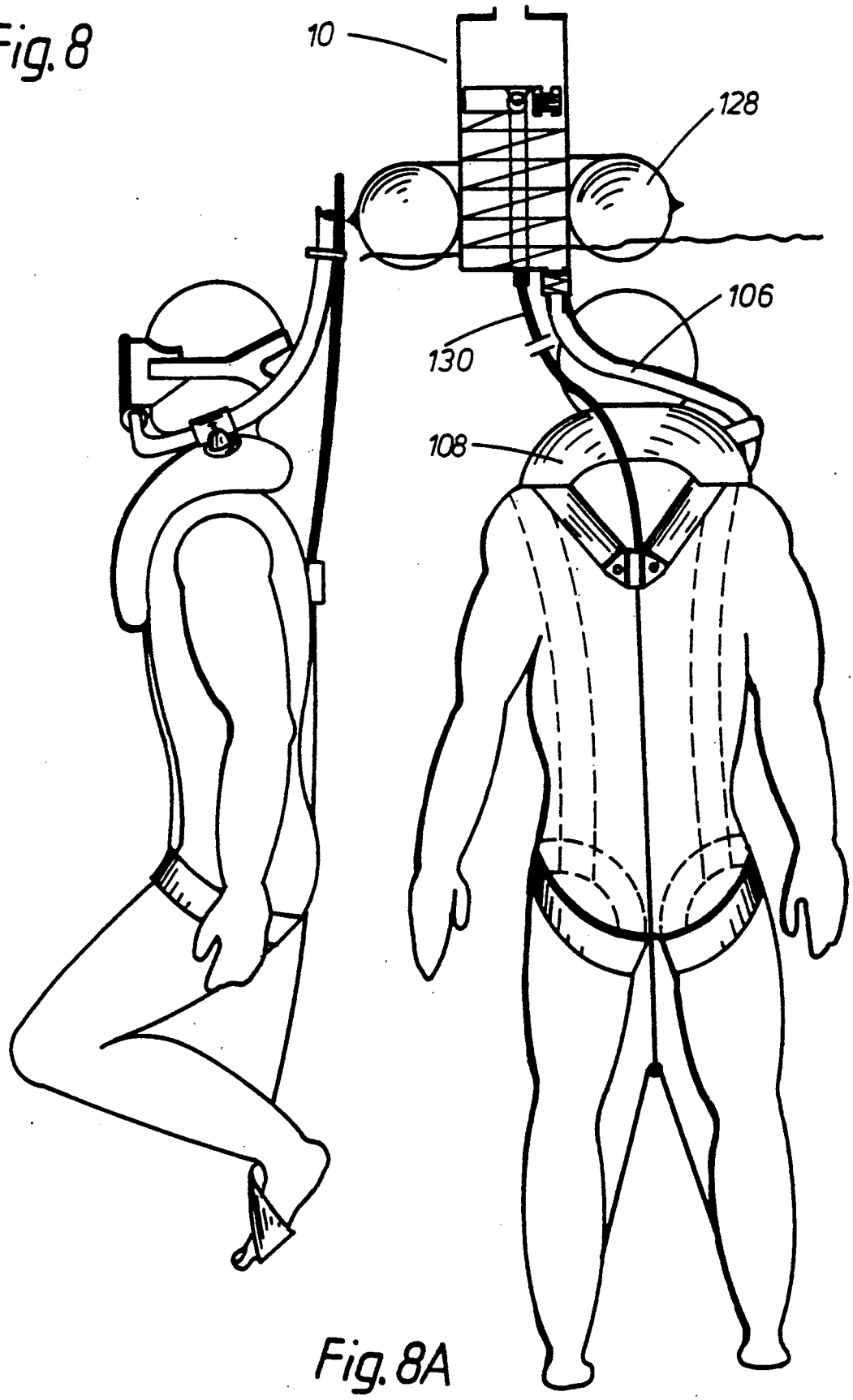
FIG. 8 is a side view and FIG. 8A is a rear view of another design of an invented diving equipment in operation, showing the pump positioned above the water surface.

In the model illustrated in FIGS. 8 and 8A, the pump (10) is kept above the surface of the water by means of an inflatable floating element (128). The set-up of the pump (10), as illustrated in FIG. 8, corresponds to that of the pump shown in FIG. 7. The pump (10) is activated by way of a Bowden wire (130). The hose (106) connects the outlet of the pump (10) to the air supply container (108). The designs, illustrated in FIGS. 7, 7A, and 8, 8A, differ therefore only in that in the construction shown in FIGS. 8 and 8A, the pump is positioned above the water surface, whereas in FIGS. 7 and 7A, it is carried on the diver's back.

Figures 9, 9A:
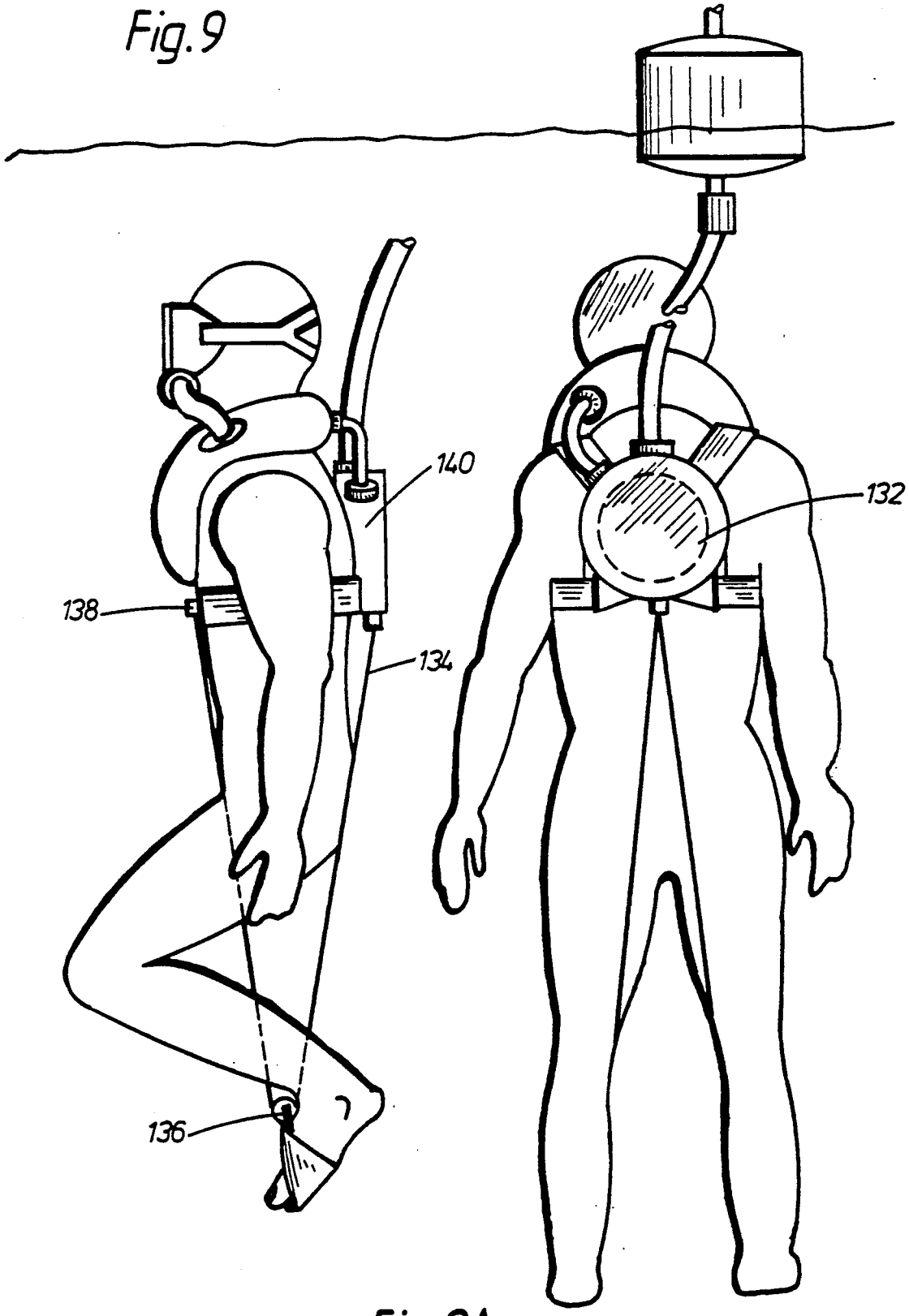
FIG. 9 is a side and FIG. 9A is a rear view of another design of an invented diving gear in operation.

In the design shown in FIGS. 9 and 9A, the pump carried on the diver's back, is constructed as a rotary pump (132), based on the design of a centrifugal pump, according to which the pulling rope (134), which activates the rotary pump (132) is guided by guiding pulleys (136), positioned at the stirrups (90). The end of the pulling rope is placed in position at the front of the chest belt (140) at fastening point (138). The strength to be summoned up by the diver will be very evenly distributed in this way.

Figures 10, 10A:
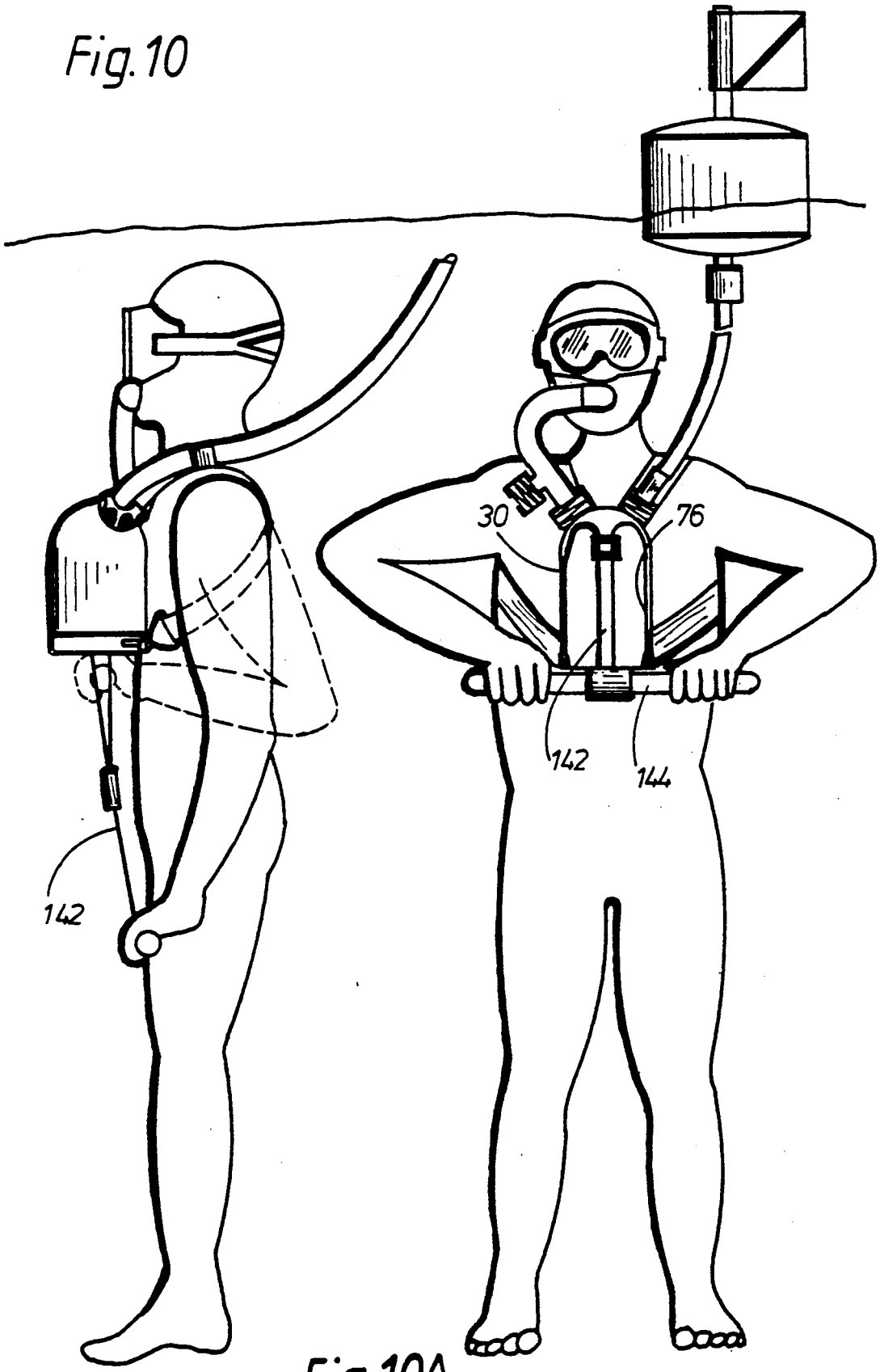
FIG. 10 is a side and FIG. 10A is a front view of another design of an invented, hand-operated diving gear in operation.

FIGS. 10 and 10A illustrates a design of a diving gear of the invention which in comparison to the above-described designs is operated by hand. The set-up of the equipment basically corresponds to that shown in FIGS. 1 and 1A, in which, however, a short belt (142) is provided in place of the belt arrangement (86) with the attached stirrups (90). This short belt is adjustable in length and at the bottom end of same a grab bar (144) is centrally secured. The length of the belt (42) is preferably adjusted in such a way that if the bellows (76) are completely tucked into the interior of the pump casing, the grab bar (144) rests against the bottom edge of the pump casing (30). The dimensioning of the pump casing is such that if the diver's arms are in a fully stretched position, the bellows (76) are extended completely from the pump casing, as illustrated in the side view of FIGS. 10 and 10A. In this illustrated design, the height of the pump casing can be 23 cm and the maximum lift about 50 cm.

Figure 13:
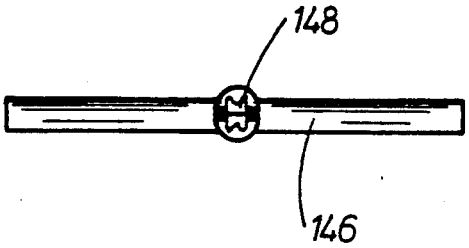
FIG. 13 is a side view of the hand-grip as shown in FIG. 11.
Figure 12:
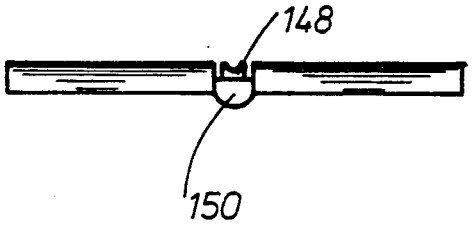
FIG. 12 is a top plan view of the hand-grip of a diving gear, as shown in FIG. 11.
Figure 11:
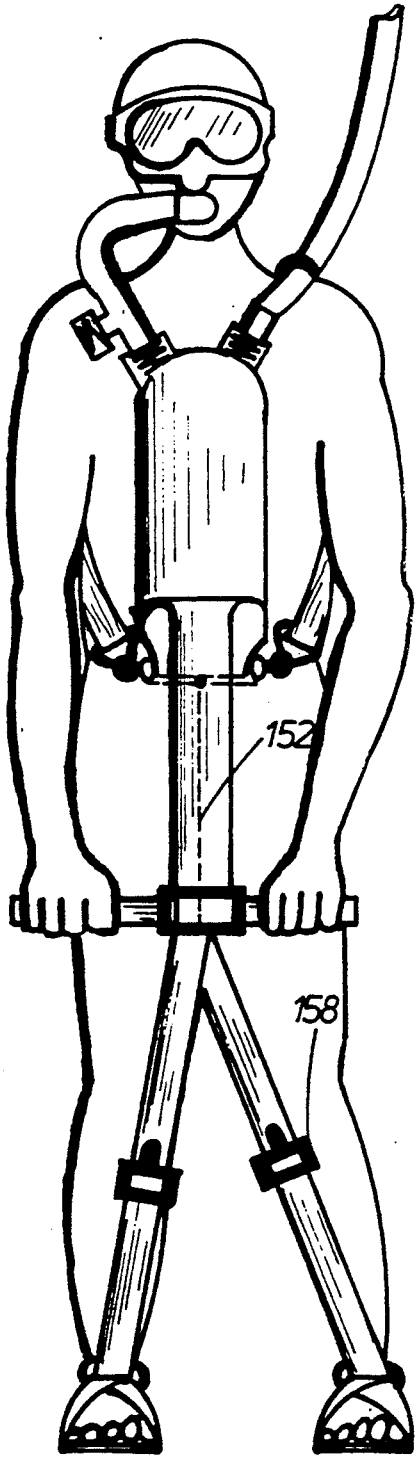
FIG. 11 is a front view of another design of an invented diving equipment in operation, which is being activated by the diver's leg movement in addition to hand movement.

FIG. 11 shows a diving gear similar to the one illustrated in FIGS. 1 and 1A. However, this diving gear is in addition equipped with a grab bar, similar to the one shown in FIGS. 10 and 10A. The grab bar (146) as shown in the top and side view in FIGS. 12 and 13 is a steel pipe with a centrally positioned roller (148) which partially encompasses a part of the casing (150) of the grab bar (146) in such a way that a rope (152) guided around the roll (148) cannot slide off from the roller (148). One end of this rope (152), as can clearly be seen from the illustration on FIG. 14, is secured to the upper fastening point (154) of the leg belt (86). The other end is secured to a fastening point (156) at the bottom edge of the pump casing (30). The length of the rope (152) corresponds approximately to the length of the pump casing (30). If required, the diver can grab and activate the grab bar with his hand in support of the foot movement. As an alternative, the pump can also be activated strictly by hand. The rope (152), including the grab bar (146), can be detachably secured to fastening point (154), e.g. it can fall into a notch and means of fastening can be provided at the pump casing (30) to which the grab bar (146) can be secured when not in use.

FIGS. 11 and FIGS. 14 and 14A also show belt buckles (158) to quickly adjust the length of the belt (86) in order to adapt some to the height of the respective diver, as well as to the required taring.

Figure 15:
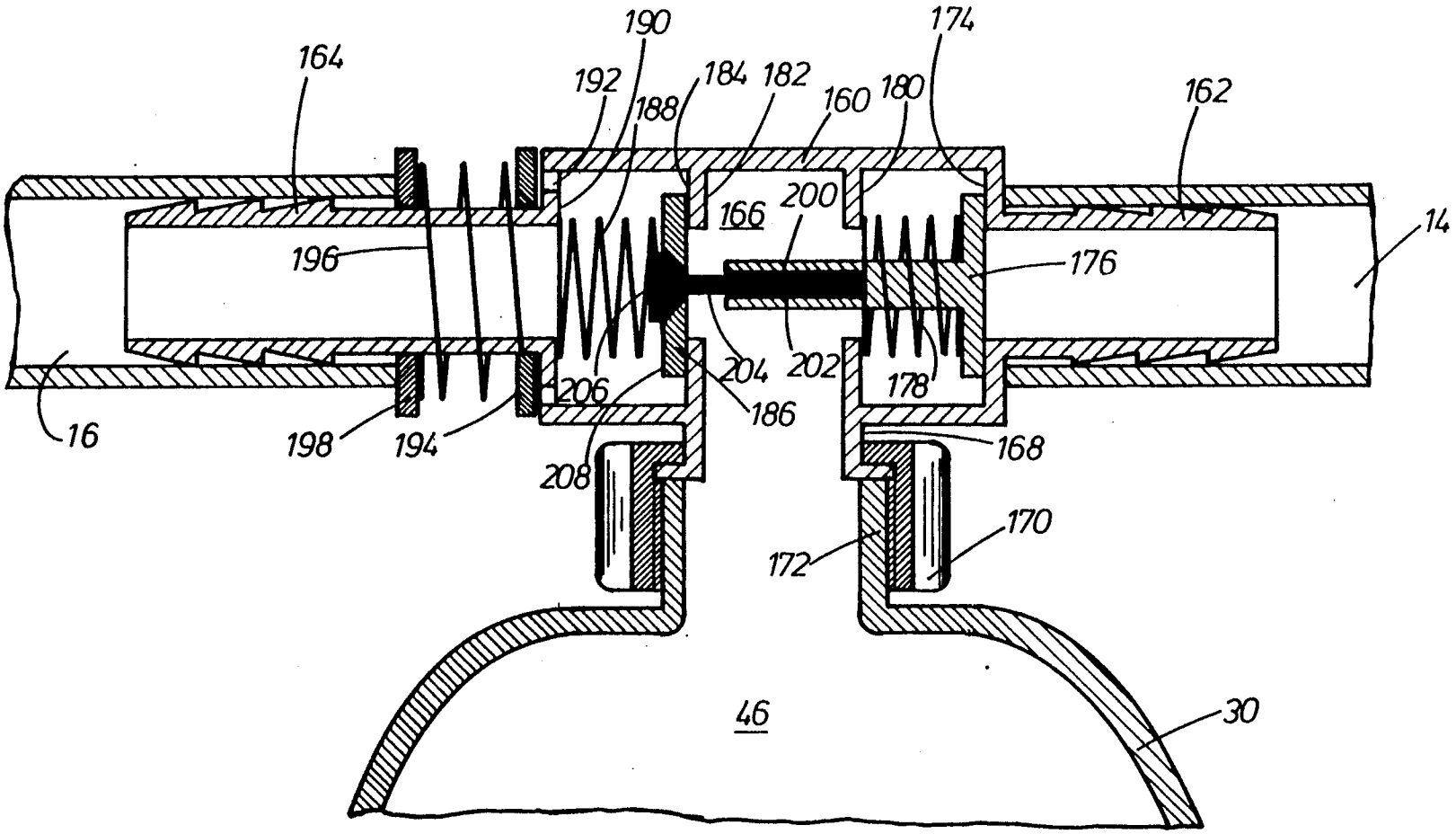
FIG. 15 shows another design of the valve unit of an invented diving equipment.

FIG. 15 shows a preferred valve arrangement as an alternative to the one illustrated in FIG. 4. In this set-up, all valves are housed in one common valve housing (160). The valve housing (160) comprises two coaxial hose connecting pieces (162, 164) which face each other, and hoses (14 and 16) can be slid over these connecting pieces. A chamber (166) is defined between the two hose connecting pieces (162, 164) from which a pipe socket (168) branches off at right angles to the axis of the hose connecting pieces (162, 164). The pipe socket (168) can be fastened by means of a screw camp (170) to a threaded ferrule (172) which projects upwards from the upper side of the pump casing (30). The chamber (166) connecting the hose connecting pieces (162, 164) is constructed cylindrically and coaxially to the hose connecting pieces and its diameter is larger than that of the hose connecting pieces. This results in creating a radial annular area (174) at the end of the hose connecting piece (162) which faces the chamber (166). This annular area serves as sealing surface and interacts with a disk-shaped valve (176) which is being pressed into a sealing position by a compression spring (178). The spring (178) supports itself against the valve (176) and against a flange (180) situated in the casing.

Another ring flange (182) situated in the valve casing (160) defines at the side which faces the hose (16) an annular area (184) which serves as sealing surface for a disk-shaped valve (186), which is kept in a sealed position by a compression spring (188). The compression spring (188) supports itself against the valve (186) and against the annular area (190) which is formed at the end of the hose connecting piece (164) which faces the casing.

The annular area (190) has several through-bores (192) which connect the interior of the valve casing (160) with the outside. A sealing ring (194) is positioned coaxially to the hose connecting piece (164) and rests from the outside against the bore-holes (192). A compression spring (196) is slid over the hose connecting piece (164) and supports itself against the sealing ring (174) and against a ring-shaped disk (198), situated at a distance from the sealing ring and propped against the end of the hose (16). Thus, the exhaust valve formed by the sealing ring (194) normally remains closed.

A shaft (200) has been constructed at the valve (176) which extends inwardly and coaxially to the valve casing (160). The shaft (200) has an axial blind-end bore (202) which accommodates the shaft (204) of another valve body (206). The shaft (204) of the valve body (206) ends through a central bore in the valve (108). The cone-shaped sealing surface of the valve body (106), which opens in the direction of the hose connecting piece (164), interacts with a correspondingly formed sealing surface of the valve (186). The length of the shaft (204) of the valve body (206) is constructed in such a way that when the valves (176 and 186) are closed, the valve body (206) rests tightly against the valve (186). However, as soon as the valve (176) lifts off from its sealing surface (174), the valve body (106) is simultaneously lifted from its sealing position allowing exhaust air to flow through the central bore (208) in the valve (186) into the pump volume (46), and thus supporting the intake of fresh air into the pump volume (46) via the hose (14).

REFERENCE LIST

| | | | |
|---|---|---|---|
| 10 | Pump | 106 | Hose |
| 12 | Activating Device | 108 | Air supply container |
| 14 | Hose | 110 | Belt |
| 16 | Hose | 112 | Piston |
| 18 | Mouthpiece | 114 | upper chamber |
| 20 | buoy | 116 | lower chamber |
| 22 | Hose connection | 118 | Non-return valve |
| 24 | Hose connection | 120 | Compression spring |
| 26 | Connecting piece | 122 | Pulling rope |
| 28 | Screw-on ring | 124 | Guide pulley |
| 30 | Pump casing | 126 | Pipe socket |
| 32 | Threaded ferrule | 128 | Floating element |
| 34 | Supporting element | 130 | Bowden wire |
| 36 | Annular area | 132 | Rotary pump |
| 38 | Compression spring | 134 | Pulling rope |
| 40 | Sealing element | 136 | Guide pulleys |
| 42 | Sealing area | 138 | Point of fastening |
| 44 | Non-return valve | 140 | Chest belt |
| 46 | Pump volume | 142 | Belt |
| 48 | Connecting piece | 144 | Grab bar |
| 50 | Screw-on ring | 146 | Grab bar |
| 52 | Adapter | 148 | Roll |
| 54 | Threaded ferrule | 150 | Part of housing of 146 |
| 56 | Chamber | 152 | Rope |
| 58 | Annular area | 154 | Point of fastening |
| 60 | Annular area | 156 | Point of fastening |
| 62 | Sealing element | 158 | Belt buckles |
| 64 | Compression spring | 160 | Valve housing |
| 66 | Non-return valve | 162 | Hose connecting piece |
| 68 | Bores | 164 | Hose connecting piece |
| 70 | Sealing ring | 166 | Chamber |
| 72 | Compression Spring | 168 | Pipe sockets |
| 74 | Exhaust Valve | 170 | Cap screw |
| 76 | Bellows | 172 | Threaded ferrule |
| 77 | Shoulder belt | 174 | Annular area |
| 78 | Shoulder belt | 176 | Valve |
| 79 | bottom edge of 76 | 178 | Spring |
| 80 | bottom edge of 30 | 180 | Flange |
| 82 | Clamping ring | 182 | Flange |
| 84 | Buckle | 184 | Annular area |
| 86 | Belt arrangement | 186 | Valve |
| 88 | Tie | 188 | Compression spring |
| 90 | Foot-loops (stirrups) | 190 | Annular area |
| 92 | Buckles | 192 | Bores |
| 94 | Piston | 194 | Sealing ring |
| 96 | Packing | 196 | Compression spring |
| 98 | Pulling rope | 198 | Ring-shaped disk |
| 100 | Guide pulley | 200 | Shaft |
| 102 | Bellows | 202 | Blind-end bore |
| 103 | Thigh straps | 204 | Shaft |
| 104 | Opening | 206 | Valve body |
| 105 | Thigh strap | 208 | Bore |

What is claimed is:

1. Diving Equipment comprising an air supply line having upper and lower ends, said upper end leading to the atmosphere above the water surface, a diver activated air pump connected to the lower end of said air supply line via a first non-return valve permitting air flow from the air supply line to the air pump, a mouthpiece connected to an air hose, said air hose connected to said air pump via a second non-return valve permitting air flow from the air pump to the mouth piece, an air outlet for exhaled air located on said air hose between said mouthpiece and said second valve, wherein the air pump comprises a rigid housing with one open side, said housing having an interior defining a pump volume, said open side being sealed by means of a flexible bellows, the flexability of said bellows permitting said bellows to be pressed into said housing or withdrawn from said housing, the interior of said housing being at all times entirely free of any structure used to compress the air in said pump other than said bellows said bellows being exposed to the air in said pump and when pressed into the interior of the rigid housing by external overpressure reduces the pump volume and compresses the air in said pump, said bellows dimensioned in such a way that it can almost completely fill the interior of the housing, an activating device connected to said bellows, for increasing the pump volume by withdrawing the bellows from the interior of said housing and wherein in use the air pump is fastened to a part of the diver's body lower than the lungs.

2. Diving equipment according to claim 1, wherein the air supply line is formed as a flexible pressure hose.

3. Diving equipment according to claim 2, wherein the upper end of the air supply line leading to the atmosphere above the water surface is fastened to a floating body.

4. Diving equipment according to claim 3, wherein the floating body comprises an inflatable buoy.

5. Diving equipment according to claim 2 wherein there is provided a valve housing containing the valves which comprises a first connecting piece for the air supply line, a second connecting piece for the air hose leading to the mouthpiece and a further connection for the pump volume of the air pump.

6. Diving equipment according to claim 1 wherein there is provided a valve housing containing the valves which comprises a first connecting piece for the air supply line, a second connecting piece for the air hose leading to the mouthpiece and a further connection for the pump volume of the air pump.

7. Diving equipment according to claim 6, wherein the first valve is connected with said second valve which, when the first valve opens, at least slightly opens the second valve connected to the air hose leading to the diver's mouthpiece.

8. Diving equipment according to claim 7, wherein the valve housing includes air outlet openings for the exhaust air as well as an exhaling valve which opens when the user of the apparatus exhales.

9. Diving equipment according to claim 6, wherein the valve housing includes air outlet openings for the exhaust air as well as an exhaling valve which opens when the user of the apparatus exhales.

10. Diving equipment according to claim 1, wherein belts are provided for fastening the air pump to the user's body.

11. Diving equipment according to claim 1, wherein the maximum pump volume of the air pump is approximately 3 to 10 liters.

12. Diving equipment according to claim 11, wherein the maximum pump volume of the air pump is approximately 6 liters.

13. Diving equipment according to claim 1, wherein the activating device comprises at least one belt, connected to the bellows of the air pump which is provided with a foot loop at its end for being connected to one of the user's feet.

14. Diving equipment according to claim 13, wherein the activating device comprises a foot loop for each foot.

15. Diving equipment according to claim 13 wherein the belt is guided around a guide pulley positioned at the foot loops and that the free end of the belt is fixedly arranged relative to the air pump.

16. Diving equipment according to claim 15, wherein the free end of the belt is fastened to the side of the user's body which is opposite to that of the air pump.

17. Diving equipment according of claim 13, wherein the belt is adjustable in length, particularly at about 40 cm to 60 cm.

18. Diving equipment according to claim 17, wherein a quick-seal closure is provided for adjusting the length of the belt.

19. Diving equipment according to claim 13, wherein the activating device provides at least one foot loop and at least one handle member, each being connected to the flexible member of the air pump.

20. Diving equipment according to claim 1, wherein the activating device comprises at least one belt having one end connected to the flexible member of the air pump and the other end connected to a handle having the form of a bar.

21. Diving equipment according to claim 1, wherein the activating device comprises a bar having a centrally disposed roller for guiding and securing a rope therearound, that one end of said rope is fastened to the bellows of the air pump, that the other end of said rope is fastened to the air pump, and that the length of the said rope corresponds approximately to the axial length of the air pump.

22. Diving equipment according to claim 1, wherein the activating device includes at least one foot loop as well as, in addition, at least one handle.

23. Diving equipment according to claim 22, wherein the additional at least one handle is releasably attached to the air pump.

* * * * *